US007600361B2

(12) United States Patent
Craig

(10) Patent No.: US 7,600,361 B2
(45) Date of Patent: Oct. 13, 2009

(54) INTERCHANGEABLE MOUTHPIECE BIT

(76) Inventor: Cory Michael Craig, 1129 S. Double or Nothing Rd., Scottsburg, IN (US) 47170

( * ) Notice: Subject to any disclaimer, the term of this patent is extended or adjusted under 35 U.S.C. 154(b) by 191 days.

(21) Appl. No.: 11/787,544

(22) Filed: Apr. 17, 2007

(65) Prior Publication Data

US 2007/0245695 A1 Oct. 25, 2007

Related U.S. Application Data

(60) Provisional application No. 60/792,567, filed on Apr. 17, 2006.

(51) Int. Cl.
*B68B 1/06* (2006.01)

(52) U.S. Cl. ..... 54/8; 54/6.1

(58) Field of Classification Search ..... 54/6.1, 54/7, 8, 9

See application file for complete search history.

(56) References Cited

U.S. PATENT DOCUMENTS

| | | | | | |
|---|---|---|---|---|---|
| 1,124,108 | A * | 1/1915 | Chenault | ..... | 54/7 |
| 3,304,692 | A * | 2/1967 | Lovell, Jr. | ..... | 54/7 |
| 3,478,493 | A * | 11/1969 | Welton | ..... | 54/7 |
| 5,062,255 | A * | 11/1991 | Myler et al. | ..... | 54/7 |
| 6,983,581 | B2 * | 1/2006 | Collins, III | ..... | 54/8 |

* cited by examiner

*Primary Examiner*—Rob Swiatek
(74) *Attorney, Agent, or Firm*—Dinsmore & Shohl LLP

(57) ABSTRACT

A shank assembly adapted for use with an interchangeable mouthpiece wherein the shank assembly comprises upper and lower shank portions that may disconnect to permit removal or replacement of the interchangeable mouthpiece, and reconnect and lock to secure placement of the mouthpiece. An adjustable bit kit is also provided comprising sets of upper and lower shank portions of different lengths which may be combined to form various shank assembly portion ratios in accordance with the training, comfort and response needs of the bridled animal.

14 Claims, 8 Drawing Sheets

INTERCHANGEABLE MOUTHPIECE BIT

RELATED APPLICATION

This application claims priority under 35 U.S.C. § 119 to U.S. provisional application Ser. No. 60/792,567, filed on Apr. 17, 2006.

FIELD OF THE INVENTION

The present invention generally relates to large animal tack, and, specifically, to an improved bridle bit for large harnessed animals, in particular, horses. The invention provides a bit assembly that permits convenient switching out of the mouthpiece and that is highly adaptable to the comfort and responsiveness of the bridled animal.

BACKGROUND OF THE INVENTION

Bits are known in the art as an aspect of an animal bridle system that permits communication with the animal, and control of the animal via conditioning where the stimulus is the application of pressure, typically to the tongue or mouth corners of the animal. A bridle secures the bit in the animal's mouth. The bit comprises a rein hanger, typically a set of rings, one on each shank assembly, to which the reins are engaged. A handler such as a trainer or rider, may pull on the reins to engender pressure on the animal, with different types and directions of pressure forming the "language" of the intended communication.

Different species of bridled animals, and different individual animals within a species, respond uniquely to different bit feels and pressures. The handler may attempt several bits before determining which bit is most suited with respect to both comfort and responsiveness, for any given animal.

A conventional bridle system comprises a bit assembly. The bit assembly comprises two shank assemblies, each comprising a set of bridle hangers at one end, and a set of rein hangers at the other end (see FIG. 3, e.g.) and one end of a mouthpiece fixedly attached along the shank such that when the bit is engaged the mouthpiece passes through the animal's mouth. Conventional bit assemblies are not designed to permit convenient switching of mouthpieces. Typically, the mouthpiece must be removed by breaking the assembly, and replaced by welding the alternative mouthpiece. According to other prior art designs exemplified by U.S. Pat. No. 3,670,476, a mouthpiece anchoring mechanism exists whereby a set of screws must be removed and replaced to change mouthpieces on a given bit assembly. Such designs have proven undesirable due to the likelihood of loose or stripped screws being lost or consumed by the bridled animal. U.S. Pat. No. 6,705,064 discloses a bit system adapted for interchanging mouthpieces by employing a shank design comprising external shank spring clips that lock the mouthpiece in place and enable replacement of the mouthpiece. However, this design requires removal of the headstall or the reigns before changing the bit, and does not permit flexibility of shank length.

Typically, due to the inconvenience and difficulty in changing mouthpieces or adapting shank length, animal handlers keep an inventory of entire bit assemblies, each with a different type of mouthpiece.

Hence, a need clearly exists in the animal bridle and tacking arts for a bit assembly permitting convenient switching out of mouthpieces without the need to replace the entire assembly. A need further exists for a bit assembly that permits a high level of adaptation to the needs and responsiveness of individual animals in a financially efficient manner.

SUMMARY OF THE INVENTION

Accordingly, the present invention provides a shank assembly that permits easy and cost-efficient replacement or switching of mouthpieces, without the need to replace other elements of the system, and without a need to remove the headstall or harness. Further, the present invention provides a bit kit that enables adaptation of the pressure effects exerted by various shank assembly upper to lower shank portion ratios, to a nearly infinite spectrum of animal comfort and responsiveness levels, with a minimum investment in parts.

One embodiment of the invention provides a shank assembly adapted for use with an interchangeable mouthpiece. The shank assembly comprises: an upper shank portion comprising a purchase and a mouthpiece securing area on which an interchangeable mouthpiece may be secured; a lower shank portion; an engaging mechanism for engaging the upper shank portion to the lower shank portion through the interchangeable mouthpiece; and a locking mechanism comprising a locking device for releasably locking the lower shank portion to the upper shank portion when the portions are engaged and releasably securing an interchangeable mouthpiece to the mouthpiece securing area.

Another embodiment of the invention is directed to a bit comprising a set of two inventive shank assemblies, and an interchangeable mouthpiece. Further embodiments relate to methods for switching out mouthpieces on a bit which rely on the use of the inventive shank assemblies and bits.

According to a further embodiment, an adjustable bit kit is provided. The kit comprises: at least two upper shank portions of length x; at least two upper shank portions of length y; at least two lower shank portions of length m; at least two lower shank portions of length n; and at least one interchangeable mouthpiece, wherein at least four bits of different upper shank to lower shank length ratios and comprising two corresponding shank assemblies may be constructed, and further wherein each shank assembly comprises: an upper shank portion comprising a purchase and a mouthpiece securing area on which an interchangeable mouthpiece may be secured; a lower shank portion; an engaging mechanism for engaging the upper shank portion to the lower shank portion through the interchangeable mouthpiece; and a locking device for releasably locking the lower shank portion to the upper shank portion when the portions are engaged, and for releasably securing the interchangeable mouthpiece to the mouthpiece securing area, and wherein x is not equal to y and m is not equal to n.

DETAILED DESCRIPTION OF THE INVENTION

Figure 1A:
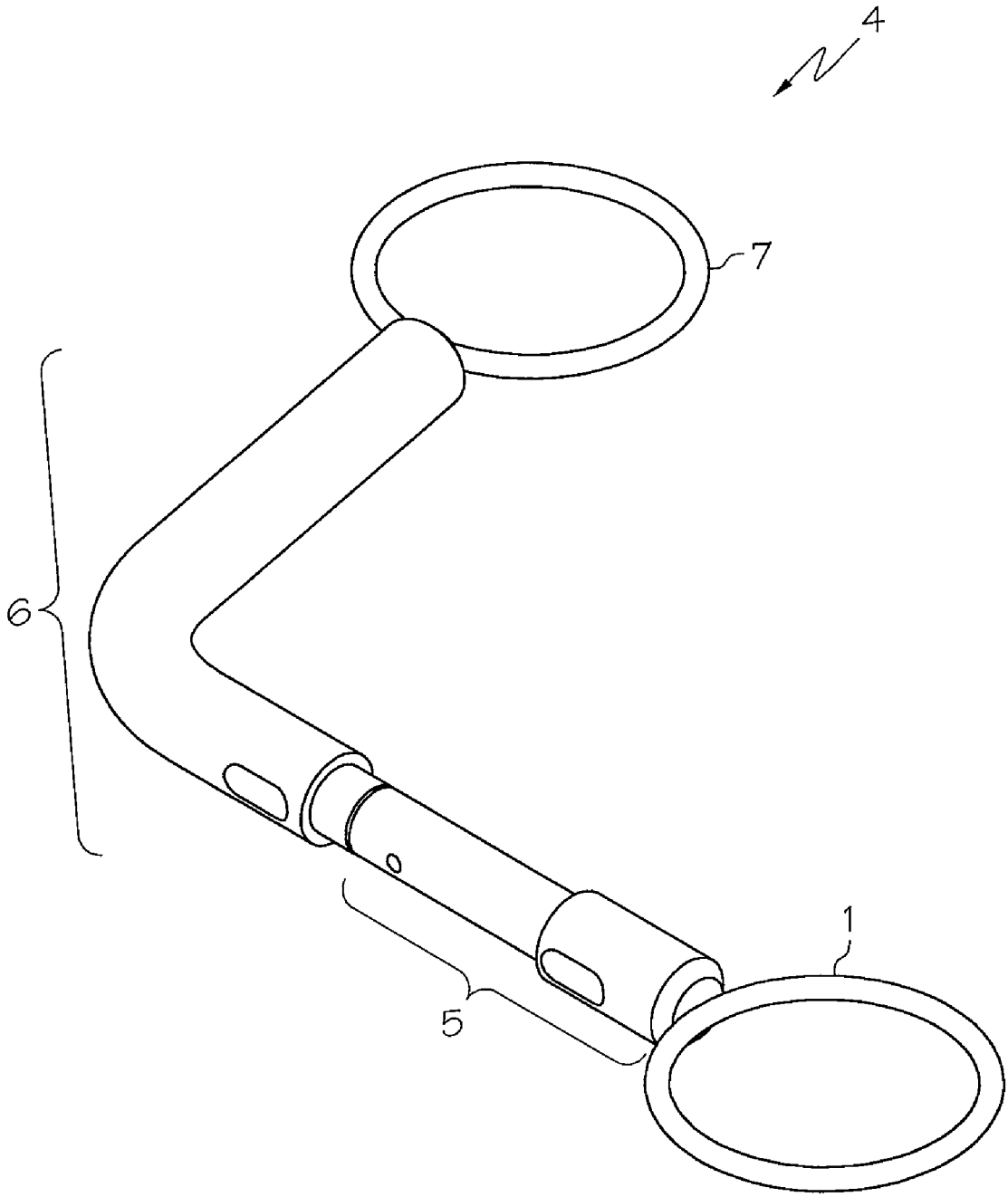
FIG. 1A: Illustrates one embodiment of shank assembly; 1B: provides transparent inner perspective of shank assembly.

The following detailed description of the invention is intended to be read with respect to the accompanying drawings. However, a person of ordinary skill in the animal tack, harness, saddlery and bridle arts will understand that the drawings are for illustrative purposes and that deviations from this description of the inventive bit and shank assembly may be made while being within the contemplated scope of the invention. In particular, the lower (6) and upper (5) shank portions may engage in a number of functionally equivalent ways, and other locking devices may function similarly to lock the engaged upper and lower shank portions through the mouthpiece, and all such configurations are contemplated as being within the scope of the present invention.

A shank, or bit shank, is also known as a cheekpiece of the bit part of a bridle, particularly when used in reference to riding on horses. The shank permits leverage to be added to the pressure exerted by the rider's hands on the bit. A shank may be made of numerous materials, although typically they are made from metal. The shank may be straight or curved and may be decorated. The headstall and curb chain of a bridle is attached to the top of the shank, such as to the ringed bridle hanger (1) as depicted in the accompanying figures. The reins are attached at the end of the lower shank, typically to a rein hanger or ring (7).

Conventionally, bits have shanks that come off the mouthpiece and create leverage in placing pressure and may also touch the sides of the mouth and jaw.

It is understood by a person of ordinary skill in the harness arts that the term "shank" may be used interchangeably with the term "cheek" to describe the entire side piece of a bit, although "shank" may also be used to refer only to the lever arm, that is, the portion of the bit that extends from the mouthpiece to the rein ring. The former definition is used herein. The "purchase" of the bit is the upper portion of the shank that extends typically from the mouthpiece to the bridle hanger or headstall ring. While nearly all shanks have bridle hangers at the top and rein rings at the bottom, certain shanks are known in the art which have additional rings or slots to attach, for example, a snaffle rein at the mouthpiece, allowing the bit to be used with two sets of reins. Other shanks may include small rings placed midway down the shank to attach, for example, a lip strap for preventing a horse from manipulating the shanks with its lips. Shanks are also known to be hobbled together by a bar or piece of leather to limit excessive motion, particularly in a loose-jawed shank design. The interchangeable aspect of the presently inventive shank assembly may be applied, with modifications that will be obvious to a person of ordinary skill in the art, to any shank design.

The length of the shank determines the degree of leverage put on the horse's head and mouth. Overall shank length, from the top of the bridle hanger to the bottom of the rein ring, is typically between about 4 and 9 inches.

The relative ratio between the length of the purchase and the shank lever arm also affects the amount and type of leverage that is applied to the chin and poll (area immediately behind the ears) of the horse. A long lower shank (sometimes referred to as a lever arm) in relation to the purchase length increases the leverage, and thus the pressure, on the curb groove and the bars of the mouth. This design is typically employed for a longer-necked horse, as it encourages the horse to both drop its head down and bring its nose in. A longer purchase in relation to the lower shank increases the pressure on the poll, but does not apply as much pressure on the bars of the mouth. This design is often more helpful on a horse with a short and thick neck, as it encourages the horse to drop its head, but with less pressure to flex the nose in, an act that is physically more difficult for a horse with a thick neck.

Overall, a bit having a shorter shank is considered a milder or less severe bit, but also responds quickly when the rider touches the reins. Short shanks are usually better for a young inexperienced horse because even when bit pressure from the rider's hands is significant, less leverage pressure is placed on the animal's head.

However, as the horse becomes more experienced in communicating via a bridle, pressure may be more subtle and a longer shank is preferred. A longer shank will rotate back further before applying pressure on the horse's mouth than shorter shanks, resulting in a warning effect that alerts the horse to respond before any significant pressure is applied to the mouth.

Shanks come in a variety of types, which may affect the action of the bit. The lower to upper shank angle varies, with some straight up and down, others curve backward, and some having an S-curve. This angle influences the angle at which the bit engages and thus way the horse carries its head. Horses that maintain a more vertical head position generally use a bit with straighter shanks, while those having a nose-out head position when working, such as cutting and roping horses, An S curve in a shank does not have a substantial effect on the angle at which the rein engages, but may alter the balance of the bit at the point where the lower shank joins the mouthpiece. A person of ordinary skill in the art will understand that the present inventive shank assembly is applicable to all varieties of bit shanks, and will recognize the modifications that may be made to accommodate certain shanks without deviating from the spirit and essence of the invention.

Figure 1B:
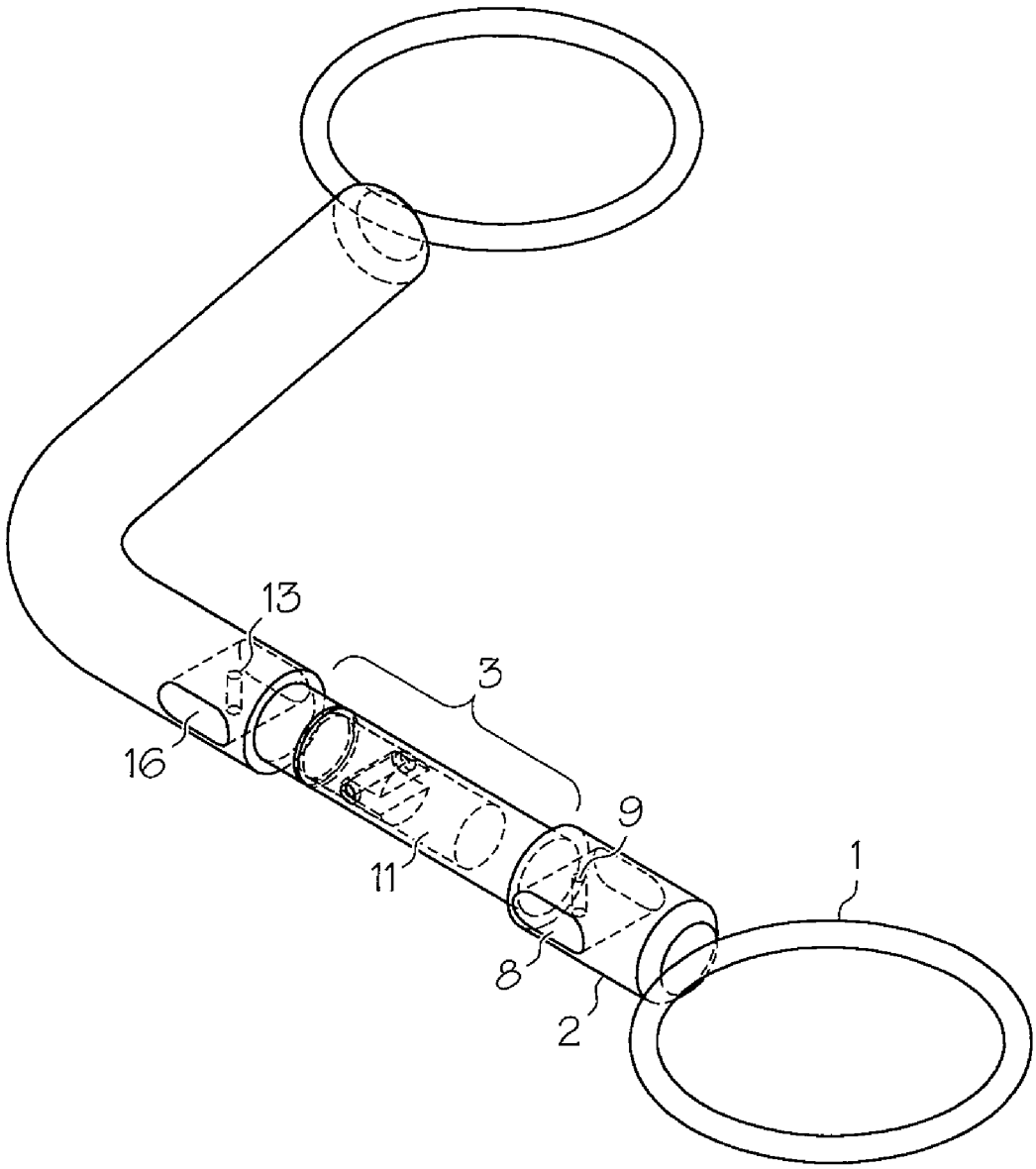
Figure 2A:
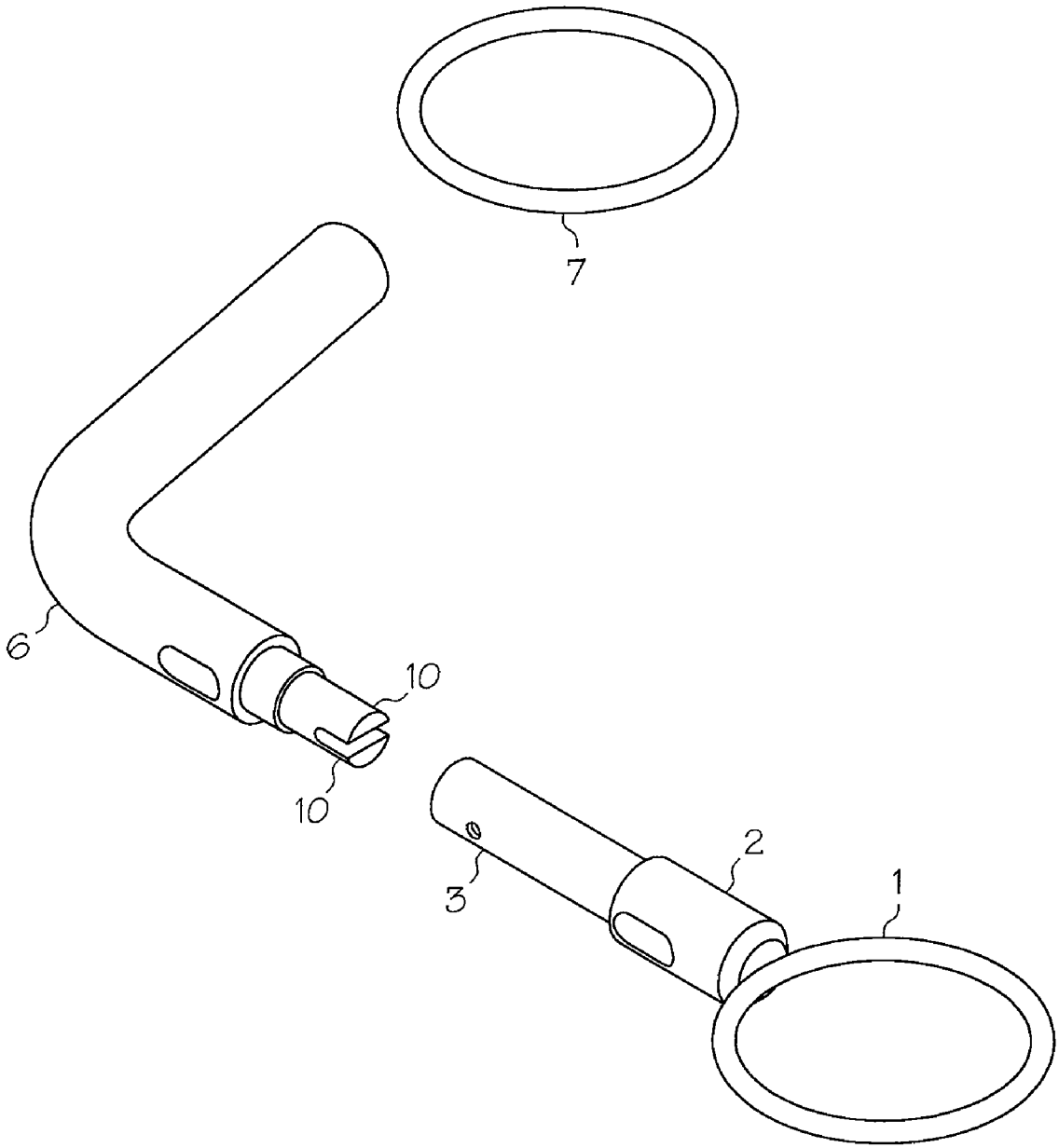
FIG. 2A: Illustrates disconnected shank assembly; 2B: provides transparent inner perspective of disconnected shank assembly.
Figure 2B:
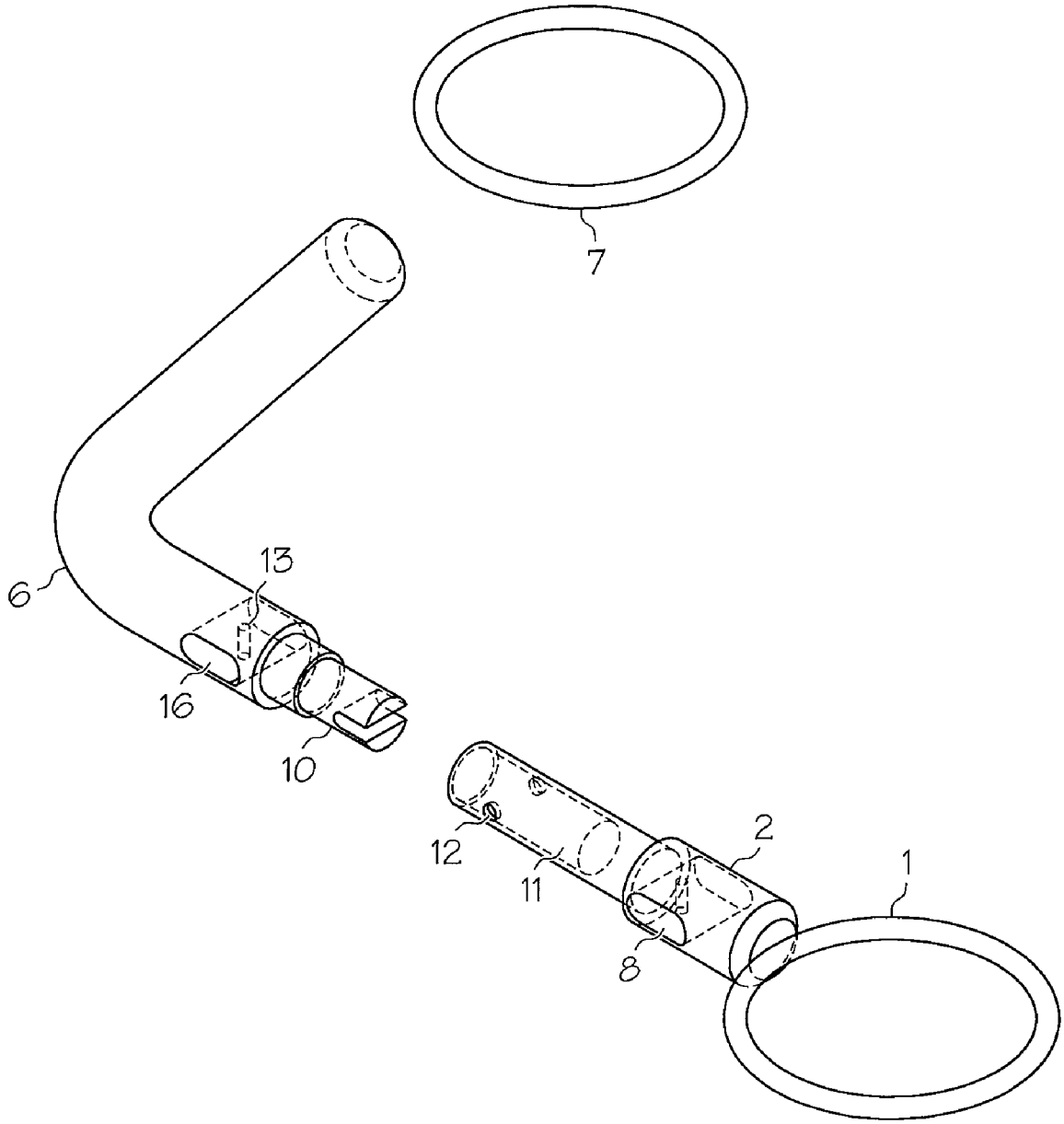
Figure 3B:
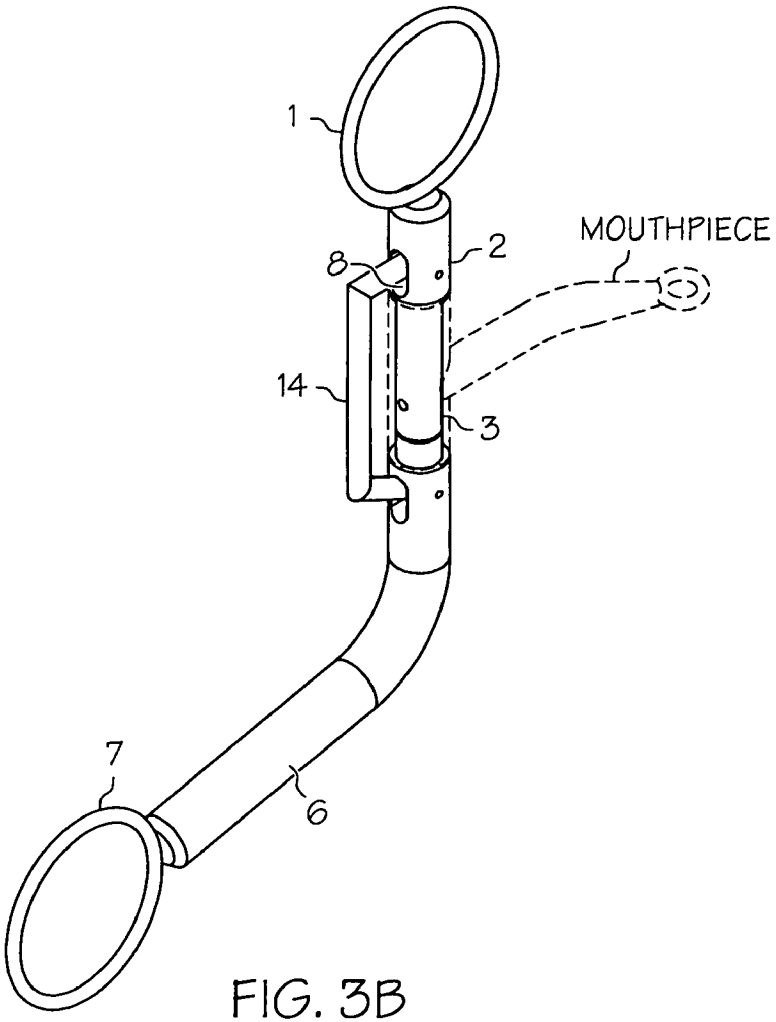
FIG. 3. Illustrates embodiment of connected and locked shank assembly according to the present invention on approximate scale of 1:2
Figure 3A:
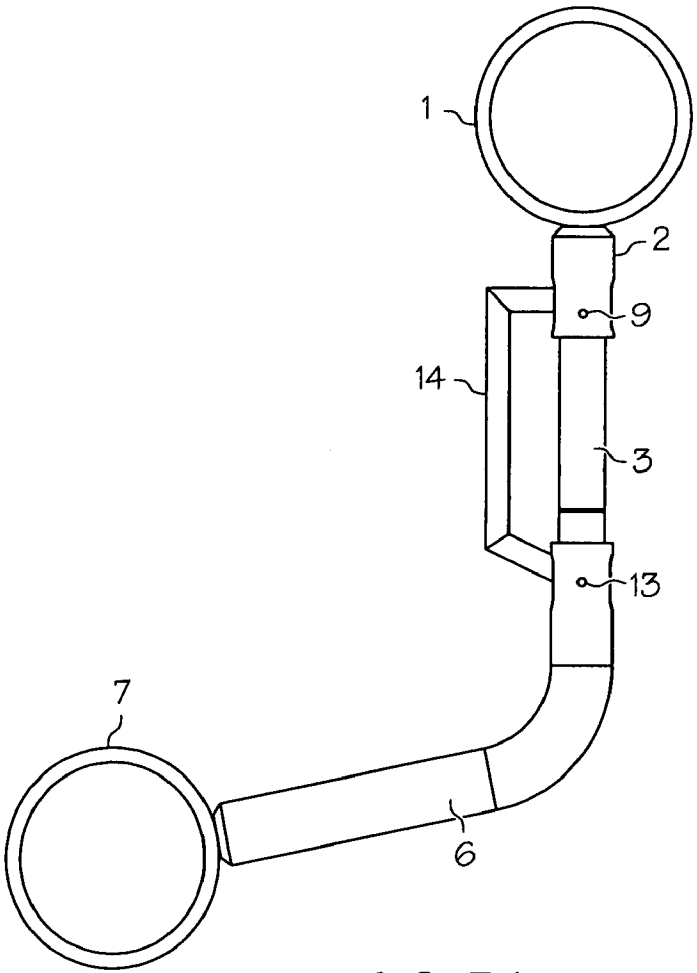
Figure 4C:
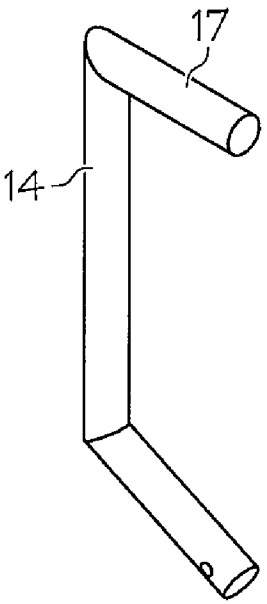
FIGS. 4B-4C: Illustrate other perspective views of locking device apart from shank assembly.
Figure 4B:
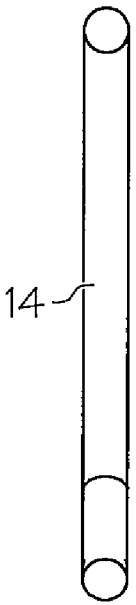
Figure 4A:
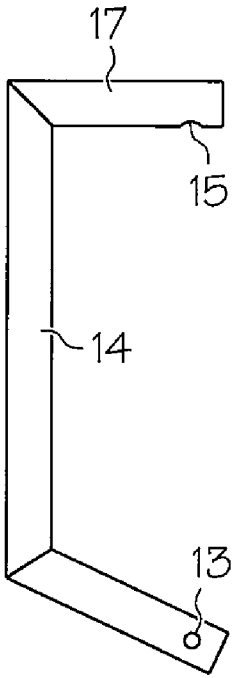
FIG. 4A: Illustrates side perspective view of locking Device or "keeper," approximate scale 1:1.
Figure 5C:
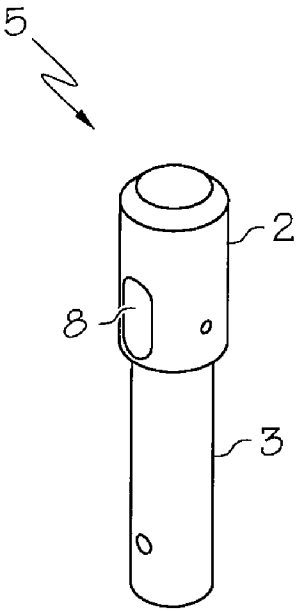
FIG. 5. Illustrates various perspective views of upper shank portion, minus bridle hanger, in approximate scale of 1:1
Figure 5B:
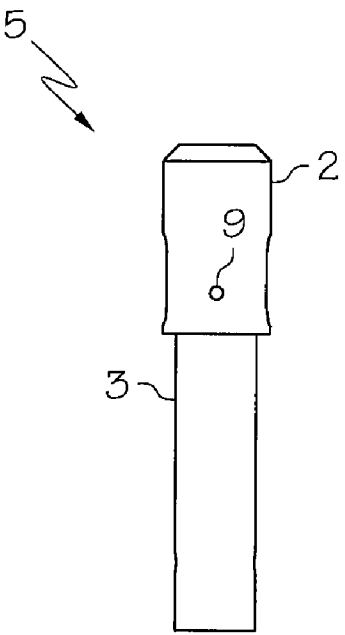
Figure 5A:
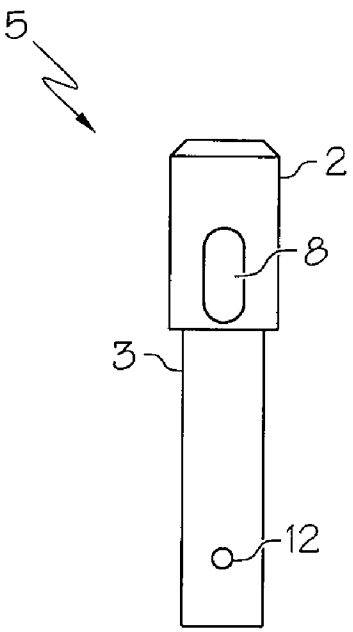
Figure 6C:
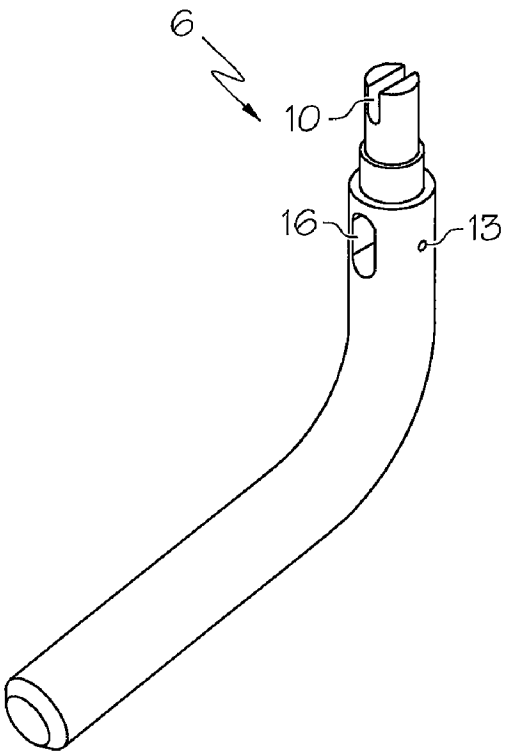
FIG. 6. Illustrates various perspective views of lower shank portion on approximate scale of 1:1
Figure 6B:
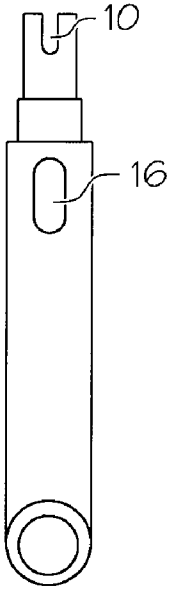
Figure 6A:
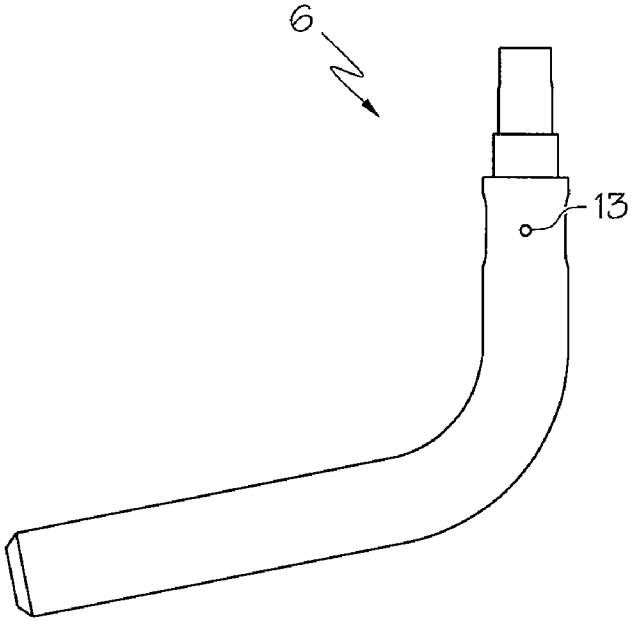

The following numbers correspond to the reference numerals set forth in the figures and apply with respect to all FIGS. 1-6 herein.

1. Bridle Hanger—attaches the headstall which goes over the horses head.

2. Purchase—the portion of upper shank that lies between the mouthpiece and the bridle hanger. The length of the purchase determines the pressure or strength of the shank assembly, whereby a relatively longer purchase is associated with a more severe pressure effect while a shorter purchase is associated with a softer effect.

3. Mouthpiece securing area, which is the pressure point to the animal's mouth.

4. Shank assembly. While the figures depict a particularly angled shank, a person of ordinary skill in the art with recognize that other angles ranging from acute angles up to and including 180 degree angles (linear) may be employed according to the invention and in accordance with the intended use of the bit.

5. Upper shank portion. This comprises the bridle hanger, the purchase, and the mouthpiece securing area.

6. Lower shank portion. A shorter shank provides less leverage, relatively, than a longer shank.

7. Rein hanger—attaches reins, held and skillfully manipulated by animal handler to communicate to the bridled animal.

8. Opening in purchase—through which the brace bar from the locking device enters to engage.

9. Role pin—in some embodiments, the brace bar of the locking device catches the role pin, holding the shank assembly together.

10. Notch—goes over a role pin and pushes the spring up. It also makes the shank turn together.

11. Spring—releasably controls the locking and unlocking of the shank assembly.

12. Role pin—holds spring in and engages (10).

13. Role pin—attaches locking device to lower shank portion.
14. Locking device—locks shank assembly together.
15. Notch on locking device—goes over role pin (9) locking the lower and upper shank portions together.
16. Hole in lower shank portion (6) to which locking device attaches to (6) by locking of role pin (13).
17. Brace bar portion of locking device.

The inventive shank assembly permits the handler to change the mouthpiece without changing the entire bit system. A conventional prior art bit system includes, for example, a dedicated headstall, reins, and curb chain, in addition to a set of shanks connected by a mouthpiece. By using the inventive assembly, the handler need only purchase and maintain a single such system and merely switch out the mouthpiece. A handler may keep an inventory of mouthpieces adapted to particular comfort and responsiveness needs of the animal, without the expense of maintaining a corresponding inventory of bridle and bit systems.

One embodiment of the invention is directed to a shank assembly adapted for use with an interchangeable mouthpiece. The shank assembly (4) comprises: an upper shank portion (5) comprising a purchase (2) and a mouthpiece securing area (3) on which an interchangeable mouthpiece may be secured; a lower shank portion (6); an engaging mechanism for engaging the upper shank portion (5) to the lower shank portion (6) through the interchangeable mouthpiece; and a locking mechanism comprising a locking device (14) for releasably locking the lower shank portion (6) to the upper shank portion (5) when the portions are engaged and releasably securing an interchangeable mouthpiece to the mouthpiece securing area (3). In specific embodiments, the upper shank portion (5) comprises a cylindrical shaft which operates as a female connector part, the lower shank portion (6) comprises a male connector part, and the engaging mechanism comprises a spring (11) which releasably compresses to permit entry of the male part into the female part resulting in complete engagement of the lower and upper shank portions.

It is understood that other means may be used to engage the upper and lower shank portions, and that in specific embodiments the male and female roles may be reversed and that such deviations are contemplated as within the scope of the invention. In other specific embodiments, the locking device (14) comprises a bottom bar and a brace bar. The bottom bar of the locking device is hingedly connected to the lower shank portion (6). Once the upper and lower shank portions are completely engaged, the engagement is maintained by hand pressure until the brace bar of the locking device (14) is inserted into the opening (8) in the upper shank portion, and wherein the bottom bar is hingedly connected to the lower shank portion (6). In a specific embodiment, the bottom bar inserts into an opening (16) in the lower shank portion (6). The hinge mechanism comprises, for example, a role pin (13) through the lower shank portion (6), then through the locking device (14), and through the other side of the shank. The hinged locking device (14) swings on the plane of the shank assembly (4) toward the upper shank portion (5). In very specific embodiments, the cylindrical shaft of the upper shank portion (5) comprises an opening (8) whereby the brace bar of the locking device (14) may enter and lock when the lower shaft portion (6) and the upper shaft portion (5) are completely engaged.

The locking device (14) may be of any shape that functions to permit the swinging and entry into the opening in the upper shank portion (5). For example, in very specific embodiments, the bottom bar of the locking device (14) forms an obtuse angle with the connecting bar, which runs substantially parallel to the shaft in locked position, and connects the bottom bar to the locking or brace bar (17). A notch (15) is cut into the brace bar (17) portion of the locking device (14). In embodiments wherein the lower shaft portion (6) comprises the male connecting part, the top of the female part is grooved, with the groove (10) running from front to back forming a notch, when pushed into engagement with the upper shank portion (5), the notch (10) catches on a pin (12). The upper and lower shank portions are pushed into engagement through the interchangeable mouthpiece. As the lower and upper shanks are pushed together, the spring (11) located in the shaft of the upper shank portion (5) compresses, permitting the shank portions to reach complete engagement. The locking device (14) is then brought and the locking or brace bar (17) is pressed through the opening in the upper shank portion (5). According to specific embodiments, when hand pressure is released, the spring (11) releases and a pin (9) in the upper shank portion (5) comes up, catching on the notch (15) on the locking device, thereby locking the upper and lower shank portions together with the mouthpiece securely positioned at the mouthpiece securing area (3).

Another embodiment is directed to an inventive bit. The bit comprises a corresponding set of the inventive shank assemblies (4), one for each cheek. Shank assemblies are said to be corresponding if they are of the same length and shape and designed to be used on concert to secure a mouthpiece. The bit further comprises an interchangeable mouthpiece which may be conveniently and efficiently removed or switched out with another interchangeable mouthpiece. In specific embodiments, the interchangeable mouthpiece comprises a mouthpiece ring at each of its two ends, and each end of the mouthpiece is attached to the shank assembly (4) by sliding the ring around either the upper (5) or lower (6) shank portions when disengaged. The attached mouthpiece is secured to the shank assembly by engaging and locking the upper and lower shank portions. According to a further embodiment, a method for replacing or switching out mouthpieces is provided. The method comprises use of the inventive bit.

According to another embodiment of the present invention, an adjustable bit kit is provided. The bit kit comprises: at least two upper shank portions of length x; at least two upper shank portions of length y; at least two lower shank portions of length m; at least two lower shank portions of length n; and at least one interchangeable mouthpiece. With a minimum of two sizes for each portion, at least four bits of different upper shank to lower shank length ratios and comprising two corresponding shank assemblies may be constructed. A bit is understood to include a set of two corresponding shank assemblies. Each shank assembly comprises: an upper shank portion comprising a purchase and a mouthpiece securing area on which an interchangeable mouthpiece may be secured; a lower shank portion; an engaging mechanism for engaging the upper shank portion to the lower shank portion through the interchangeable mouthpiece; and a locking device for releasably locking the lower shank portion to the upper shank portion when the portions are engaged, and for releasably securing the interchangeable mouthpiece to the mouthpiece securing area. It is understood that x is not equal to y and m is not equal to n, but may be any lengths such that the sum of the lengths is between 4 and 10 inches. In specific embodiments, the sum of the lengths is 8½ inches. In specific embodiments, the upper shank portion comprises a cylindrical shaft which operates as a female connector part, the lower shank portion comprises a male connector part, and the engaging mechanism comprises a spring which releasably compresses to permit entry of the male part into the female part resulting in complete engagement of the lower and upper shank portions, wherein complete engagement is maintained by hand pressure. It is understood that the male and female connector roles may be switched and still be within the scope of the invention.

A bit kit provides maximum flexibility with respect to adapting a bit to as many different animal comfort and responsive needs as required. The inventive shank assembly may be formed from a combination of purchases (2) of different lengths and lower shank portions of different lengths. As the inventive shank assembly is easily disconnected and connected in accordance with the present invention, the inventive bit kit permits the construction of a variety of shank assemblies comprising permutations of the purchase (2) length and the lower shank portion (6) length. As noted, the length of the purchase (2) determines the pressure or strength of the shank assembly (4). The length and configuration of the lower shank (6) determines the amount of leverage of the bit, with a shorter lower shank providing less leverage and a longer lower shank providing greater leverage. One embodiment of the present invention is directed to a bit kit that allows for four combinations of the shank assembly (4) based on purchase (2) and lower shank (6) lengths: (1) short purchase—short shank; (2) long purchase—long shank; (3) short purchase—long shank; and (4) long purchase—short shank. It will be understood that a bit comprises a corresponding set of shank assemblies, such that the number required of a given length is at least two.

As is understood by a person of ordinary skill in the art, bit mouthpieces are constructed to provide different types of pressure effect on the bridled animal. One such pressure effect is known as the "nut cracker" effect and is exemplified by use of a "snaffle" mouthpiece. A "tongue pressure" effect, exemplified by use of a correction mouthpiece, relies on the application of pressure to the tongue. A "tongue release" effect is achieved by leaving space between the tongue and the bit and pressure is applied on the bars of the mouth. This pressure effect is achieved, for example, by use of a sweet water mouthpiece. Other pressure effects and mouthpieces are known in the art, and the following examples are provided for illustrative purposes.

EXAMPLE

The following example illustrates pressure effect variations achievable in accordance with use of the inventive bit kit, with respect to particular mouthpieces known in the art for particular comfort, response, and experience suitability in handling horses. The inventive kit provides two upper shank portions (purchase) of different lengths and two lower shank portions of different lengths that may be connected in accordance with the present invention to form four shank assemblies suitable for different training experiences or response needs of the horse.

Short Purchase+Short Lower Shank

One embodiment of the invention provides a shank assembly comprising a short purchase in combination with a short lower shank. A short purchase provides less severe pressure than a longer purchase. A shorter lower shank provides less leverage than a longer lower shank. When used with the snaffle mouthpiece, this assembly provides the least severity.

A correction mouthpiece is typically constructed in 3 pieces, collapsing on the tongue, and is employed to achieve a tongue pressure effect. The short purchase/short lower shank assembly is the mildest in severity of the four combinations for tongue pressure effect.

A sweet water mouthpiece works is typically employed to achieve a tongue release and bar pressure effect. The shank assembly comprising a short purchase in combination with a short lower shank provides the least severe pressure in the tongue release pressure effect.

Long Purchase+Long Lower Shank

A long purchase provides a more severe pressure effect generally than a short purchase, while a long lower shank provides more leverage than a short lower shank. With respect to mouthpieces designed to impart any of the desired pressure effects, including the nut cracker pressure effect, the tongue pressure effect and the tongue release effect, the most severe pressure effect is achieved by this shank assembly combination.

Short Purchase+Long Lower Shank/Long Purchase+Short Lower Shank

These shank assembly combinations permits a high degree of individualization and capacity for custom bit construction and bridling. With several different lengths of each section, a trainer or handler may attempt several combinations of differing pressure and leverage to determine a feel that engenders optimal results in a given animal. Such a kit would be particularly useful over the training period, as pressure sensitivities and responsiveness will change incrementally over the course of learning.

It will be clear that many variations in addition to those specifically set forth are achievable by varying purchase length with shank length.

In addition, mouthpieces are known in the art which are designed to provide combined pressure effects. It is understood that the term "port" refers to a mouthpiece in the horse tacking vernacular of some regions. For example, a "low port" mouthpiece provides a combination of tongue pressure, bar pressure, and some tongue release effect. "Medium port" provides approximately equal amounts of bar pressure and tongue release, and less tongue pressure. "High port" mouthpieces are designed to provide greater relative amounts of bar pressure, less tongue release, and very little tongue pressure. Other well-known examples of mouthpieces designed to provide combined pressure effects include low, medium and high correction mouthpieces, and small, medium and high spoon mouthpieces. The present inventive shank assembly permits a high level of adaptation of the pressure effects to the needs of the trainer and in accordance with the responses of the animal.

What is claimed:

1. A shank assembly adapted for use with an interchangeable mouthpiece, the shank assembly comprising: an upper shank portion comprising a purchase and a mouthpiece securing area on which an interchangeable mouthpiece may be secured; a lower shank portion; an engaging mechanism for engaging the upper shank portion to the lower shank portion through the interchangeable mouthpiece and said mouthpiece securing area; and a locking mechanism comprising a locking device for releasably locking the lower shank portion to the upper shank portion when the portions are engaged and releasably securing an interchangeable mouthpiece to the mouthpiece securing area.

2. The shank assembly according to claim 1, wherein the upper shank portion comprises a cylindrical shaft which operates as a female connector part, the lower shank portion comprises a male connector part, and the engaging mechanism comprises a spring which releasably compresses to permit entry of the male part into the female part resulting in complete engagement of the lower and upper shank portions.

3. The shank assembly according to claim 2, wherein complete engagement is maintained by hand pressure.

4. The shank assembly according to claim 3, wherein the locking device comprises a bottom bar and a brace bar, and wherein the bottom bar is hingedly connected to the lower shank portion.

5. The shank assembly according to claim 4, wherein the cylindrical shaft comprises an opening whereby the brace bar of the locking device may enter and lock when the lower shaft portion and the upper shaft portion are completely engaged.

6. The shank assembly according to claim 5, wherein the locking device locks when hand pressure is released.

7. A bit comprising: a set of two shank assemblies according to claim 1, and an interchangeable mouthpiece.

8. The bit according to claim 7, wherein the interchangeable mouthpiece comprises a mouthpiece ring at each of its two ends, and each end of the mouthpiece is attached to the shank assembly by sliding the ring around either the upper or lower shank portions when disengaged.

9. The bit according to claim 8, wherein the attached mouthpiece is secured to the shank assembly by engaging and locking the upper and lower shank portions.

10. A method for replacing a mouthpiece on a bit comprising a shank assembly having upper and lower shank portions, the method comprising use of the bit according to claim 9 and further including the steps of:

(a) unlocking the shank assembly to disengage the upper and lower shank portions;

(b) removing a first interchangeable mouthpiece;

(c) sliding a second interchangeable mouthpiece onto the shank assembly;

(d) engaging the upper and lower shank portions; and (e) locking the shank assembly.

11. A adjustable bit kit comprising: at least two upper shank portions of length x; at least two upper shank portions of length y; at least two lower shank portions of length m; at least two lower shank portions of length n; and at least one interchangeable mouthpiece, wherein at least four bits of different upper shank to lower shank length ratios and comprising two corresponding shank assemblies may be constructed, and further wherein each shank assembly comprises: an upper shank portion comprising a purchase and a mouthpiece securing area on which an interchangeable mouthpiece may be secured; a lower shank portion; an engaging mechanism for engaging the upper shank portion to the lower shank portion through the interchangeable mouthpiece; and a locking device for releasably locking the lower shank portion to the upper shank portion when the portions are engaged, and for releasably securing the interchangeable mouthpiece to the mouthpiece securing area, and wherein x is not equal to y and m is not equal to n.

12. The adjustable bit kit according to claim 11, wherein the upper shank portion comprises a cylindrical shaft which operates as a female connector part, the lower shank portion comprises a male connector part, and the engaging mechanism comprises a spring which releasably compresses to permit entry of the male part into the female part resulting in complete engagement of the lower and upper shank portions, wherein complete engagement is maintained by hand pressure.

13. The adjustable bit kit according to claim 12, wherein the locking device comprises a bottom bar and a brace bar, and wherein the bottom bar is hingedly connected to the lower shank portion, and further wherein the cylindrical shaft comprises an opening whereby the brace bar of the locking device may enter and lock when the lower shaft portion and the upper shaft portion are completely engaged.

14. The adjustable bit kit according to claim 13, wherein the locking device locks when hand pressure is released.

* * * * *